US011969639B1

(12) United States Patent
Mason et al.

(10) Patent No.: US 11,969,639 B1
(45) Date of Patent: Apr. 30, 2024

(54) GOLF SWING FORCE SHIFT INDICATOR

(71) Applicants: Bradley R. Mason, Rancho Santa Fe, CA (US); Jeffrey T. Mason, Valley Center, CA (US)

(72) Inventors: Bradley R. Mason, Rancho Santa Fe, CA (US); Jeffrey T. Mason, Valley Center, CA (US)

( * ) Notice: Subject to any disclaimer, the term of this patent is extended or adjusted under 35 U.S.C. 154(b) by 25 days.

(21) Appl. No.: 17/978,090

(22) Filed: Oct. 31, 2022

(51) Int. Cl.
*A63B 69/36* (2006.01)

(52) U.S. Cl.
CPC ..... *A63B 69/3673* (2013.01)

(58) Field of Classification Search
CPC ..... A63B 69/3673
USPC ..... 473/219, 261, 269, 270, 272, 278, 279
See application file for complete search history.

(56) References Cited

U.S. PATENT DOCUMENTS

D134,341 S * 11/1942 Churchill ..... D21/688
2,803,461 A * 8/1957 Coplin ..... A63B 21/0004 482/146
4,088,325 A * 5/1978 Sutton ..... A63B 69/3667 472/110
5,203,279 A * 4/1993 Eversdyk ..... A01K 15/027 119/702
5,897,474 A * 4/1999 Romero ..... A63B 22/14 482/79
7,018,301 B1 * 3/2006 Cascerceri ..... A63B 69/3673 473/270
7,625,294 B1 * 12/2009 Isaac ..... A63B 69/3667 473/218
2009/0029789 A1 * 1/2009 Davies ..... A63B 69/3667 473/218

* cited by examiner

*Primary Examiner* — Nini F Legesse
(74) *Attorney, Agent, or Firm* — CP LAW GROUP PC; Cy Bates

(57) ABSTRACT

A device is provided that indicates to a user when the user has properly shifted a sufficient amount of his or her downward force to the trail foot and thereafter to the lead foot during the course of a golf swing, thereby effecting an optimal golf swing.

18 Claims, 10 Drawing Sheets

GOLF SWING FORCE SHIFT INDICATOR

FIELD OF THE INVENTION

The present invention relates generally to the sport of golf and more particularly to devices and methods used to improve a golf swing.

BACKGROUND

An important element of a golf swing is the ability of a golfer to properly shift the majority of the golfer's downward force directed against the ground from one foot to the other at appropriate stages of the swing. This swing element is particularly important in the long game where the golfer is taking a full swing off the tee or fairway. As a general rule, a golfer desirably applies the majority of the golfer's downward force with the trail foot during the backswing and applies the majority of the golfer's downward force with the lead foot during the downswing. As such, the present invention recognizes the need for a device that confirms that a golfer is applying the correct downward force loading to the appropriate foot at the appropriate stage of the swing. Accordingly, it is an object of the present invention to enable a golfer to achieve an optimal golf swing by providing the golfer with a real time indication that the golfer has properly shifted from a balanced downward force distribution to an unbalanced rearward-dominant downward force distribution during the backswing, thereby applying a majority of the golfer's downward force toward the ground with the trail foot. It is a further object of the present invention to provide the golfer with a real time indication that the golfer has properly shifted from the unbalanced rearward-dominant downward force distribution to an unbalanced forward-dominant downward force distribution during the downswing, thereby applying a majority of the golfer's downward force toward the ground with the lead foot. It is another object of the present invention to provide such a device that is simply constructed and forgoes any electronics, instead operating in a non-electrical, strictly manual manner.

These objects and others are accomplished in accordance with the invention described hereafter.

SUMMARY OF THE INVENTION

The present invention may be generally characterized as a device that enables an optimal golf swing by indicating to a user in real time when the force distribution of the user's total downward force shifts during the backswing from a balanced downward force distribution to an unbalanced rearward-dominant downward force distribution so that the majority of the user's downward force is applied toward the ground via the trail foot. The invention is further generally characterized as a device that enables an optimal golf swing by indicating to the user in real time when the unbalanced rearward-dominant downward force distribution shifts during the downswing to an unbalanced rearward-dominant downward force distribution so that the majority of the user's total downward force is applied toward the ground via the lead foot. The device may be more particularly characterized as a golf swing force shift indicator that includes a top face, a bottom face, a front face and a rear face. The front face is positioned at a front end of the force shift indicator, the rear face is positioned at a rear end of the force shift indicator and the bottom face extends from the front end to the rear end of the force shift indicator. A continuous unitary plane forms the top face and extends from the front end to the rear end of the force shift indicator. The top face has a lead foot placement site with a longitudinal centerline. The lead foot placement site is positioned more proximal to the front end than to the rear end. The top face also has a trail foot placement site with a longitudinal centerline. The trail foot placement site is positioned more proximal to the rear end than to the front end.

A bottom front plane, a bottom central plane and a bottom rear plane form the bottom face. The bottom front, central and rear planes are sequentially positioned relative to one another in a series along the length of the bottom face. The bottom central plane is preferably parallel to the top face. The bottom front plane has a different angular orientation relative to the bottom central plane. The angular orientation of the bottom front plane defines a forward angle of incline that is preferably upward relative to the bottom central plane. The forward angle of incline is preferably less than 30°. The bottom rear plane likewise has a different angular orientation relative to the bottom central plane. The angular orientation of the bottom rear plane defines a rearward angle of incline that is preferably upward relative to the bottom central plane. The rearward angle of incline is preferably less than 30°.

The bottom central plane intersects the bottom front plane along a forward pivot axis and intersects the bottom rear plane along a rearward pivot axis. A longitudinal distance between the forward pivot axis and the longitudinal centerline of the lead foot placement site defines a forward leverage distance and a longitudinal distance between the rearward pivot axis and the longitudinal centerline of the trail foot placement site defines a rearward leverage distance. The rearward leverage distance is preferably greater than the forward leverage distance.

The golf swing force shift indicator preferably additionally includes two or more forward projections extending downwardly from the forward pivot axis and two or more rearward projections extending downwardly from the rearward pivot axis.

The invention will be further understood from the accompanying drawings and description.

BRIEF DESCRIPTION OF THE DRAWINGS

The below-listed drawing figures illustrate one or more embodiments of the present invention by way of example and not by way of limitation. Common reference characters are used among the different drawing figures to indicate the same structural elements.

DETAILED DESCRIPTION OF THE INVENTION

Figure 1:
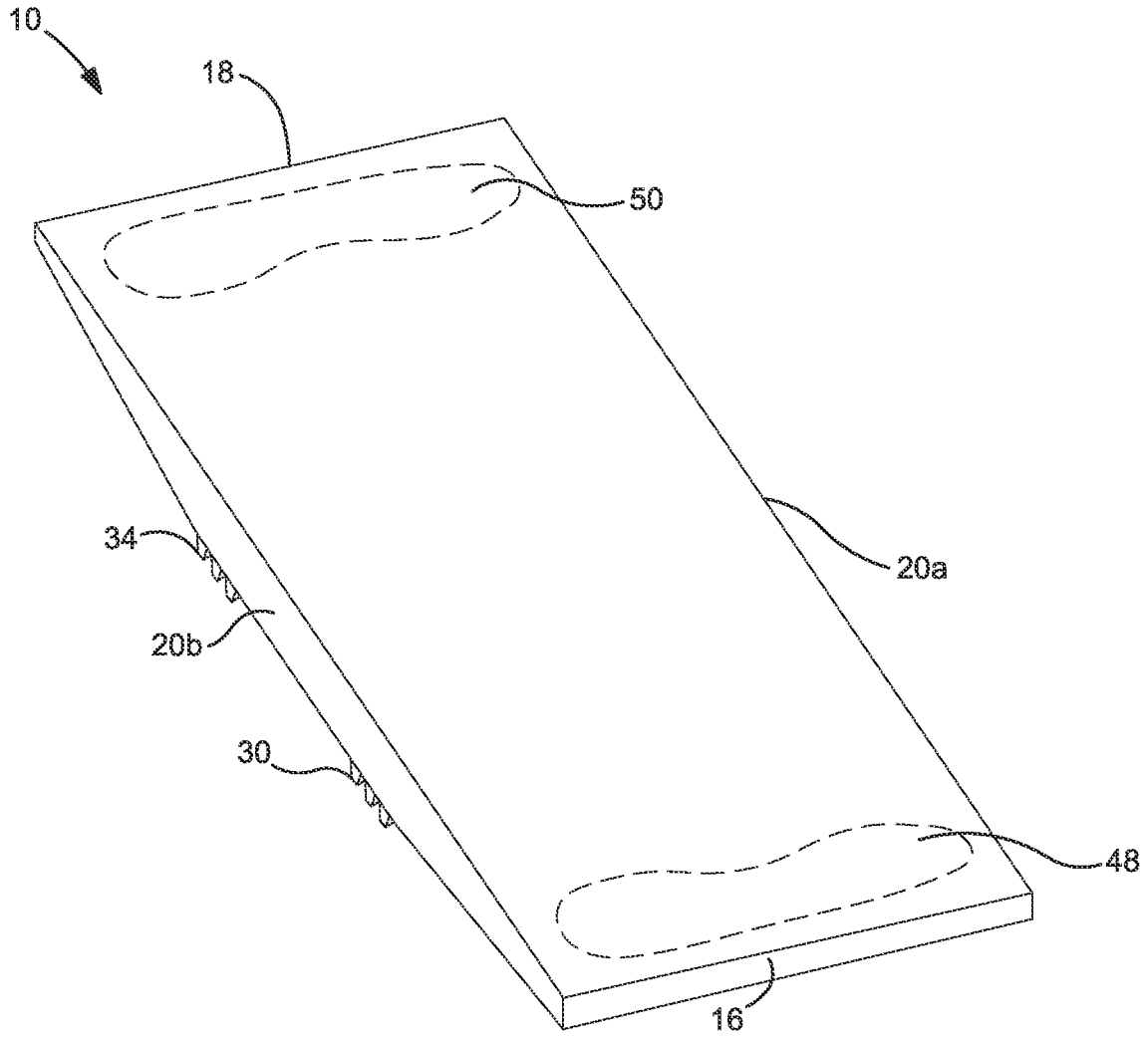
FIG. 1 is a perspective view of a golf swing force shift indicator.

Referring to FIGS. 1-7, a golf swing force shift indicator is shown and generally designated 10. The force shift indicator 10 is a three-dimensional solid having the approximate configuration of a six-sided rectangular cuboid. As such, the force shift indicator 10 is bounded by six planar faces, namely, a top face 12, a bottom face 14, a front face 16, a rear face 18, a first lateral face 20*a* and a second lateral face 20*b*. The top face 12 and bottom face 14 are on opposing sides of the force shift indicator 10. The top face 12 faces upward and the bottom face 14 faces downward when the force shift indicator 10 is in use. The precise angular orientations of the top and bottom faces 12, 14 vary during use of the force shift indicator 10, but both of their orientations are much closer to horizontal than vertical at all times during use as described below. As such, the angular orientations of the top and bottom faces 12, 14 may be characterized as substantially horizontal, wherein the term "substantially horizontal" encompasses true horizontal and deviations less than 45° from true horizontal.

The front face 16 and rear face 18 are on opposing sides of the force shift indicator 10, preferably in parallel vertical alignment with one another. The faces 16, 18 maintain a substantially vertical orientation during use of the force shift indicator 10, wherein the term "substantially vertical" encompasses true vertical and deviations less than 45° from true vertical. The front face 16 faces forward and the rear face 18 faces backward when the force shift indicator 10 is in use. The height of the front face 16 corresponds to the thickness of the force shift indicator 10 at its front end and the height of the rear face 18 corresponds to the thickness of the force shift indicator 10 at its rear end. Each face 12, 16, 18 is a single substantially continuous unitary plane having a substantially rectangular profile. The top face 12 intersects each face 16, 18, 20*a*, 20*b* at right angles and the intersections are straight lines that define the top edges of the force shift indicator 10.

Unlike the top face 12 that consists in its entirety of a single continuous unitary plane, the bottom face 14 comprises three discrete rectangular planes, namely, a bottom front plane 22, a bottom central plane 24 and a bottom rear plane 26. The three bottom planes 22, 24, 26 are sequentially positioned in a series along the length of the bottom face 14. Each of the bottom planes 22, 24, 26 has the same width, corresponding to the constant width of the top face 12. However, the bottom front plane 22 and bottom rear plane 26 each has a different length relative to the other. The bottom front plane 22 also has a different angular orientation relative to the bottom central plane 24. The bottom rear plane 26 likewise has a different angular orientation relative to the bottom central plane 24.

The bottom central plane 24, which is connectively positioned between the bottom front and bottom rear planes 22, 24, is aligned parallel to the top face 12. Consequently, the distance between the bottom central plane 24 and top face 12, i.e., the thickness of the force shift indicator 10, is constant along the entire length of the bottom central plane 24. The bottom central plane 24 intersects the bottom front plane 22 along a forward line of intersection 28 termed a forward pivot axis that extends widthwise across the bottom face 14 substantially perpendicular to the longitudinal axis of the force shift indicator 10 and substantially parallel to the front face 16. The bottom front plane 22 extends forwardly away from the bottom central plane 24 and forward pivot axis 28 toward the front end of the force shift indicator 10 which is one and the same as the front face 16 of the force shift indicator 10. The front end and front face 16 of the force shift indicator 10 are alternately termed the lead end and lead face 16, respectively.

The bottom front plane 22 is oriented at an upward angle relative to true horizontal. This upward angle is termed a forward angle of incline. Consequently, the distance between the bottom front plane 22 and top face 12, i.e., the thickness of the force shift indicator 10, decreases as the bottom front plane 22 approaches the front end of the force shift indicator 10. The forward pivot axis 28 functions as a forward fulcrum enabling the front end of the force shift indicator 10 to rotate up or down about it when the force shift indicator 10 is in use. A plurality of short, narrow, tapered, spike-like forward projections 30 are preferably integrally formed on the bottom face 12, extending downwardly from the forward pivot axis 28. The forward projections 30 are arranged in an array of three longitudinally spaced apart rows in the present embodiment. One row is positioned directly on the forward pivot axis 28 in substantially perpendicular alignment with the bottom central plane 24 and the remaining two rows are positioned immediately adjacent to the forward pivot axis 28 on the bottom front plane side thereof.

The bottom central plane 24 intersects the bottom rear plane 26 along a rearward line of intersection 32 termed a rearward pivot axis that extends widthwise across the bottom face 14 substantially perpendicular to the longitudinal axis of the force shift indicator 10 and substantially parallel to the rear face 18. As such, the forward and rearward pivot axes 28, 32 are aligned substantially parallel to one another. The bottom rear plane 26 extends rearwardly away from the rearward pivot axis 32 and bottom central plane 24 toward the rear end of the force shift indicator 10, which corresponds to the rear face 18 of the force shift indicator 10. The rear end and rear face 18 of the force shift indicator 10 are alternately termed the trail end and trail face 18, respectively.

The bottom rear plane 26 is oriented at an upward angle relative to true horizontal. This upward angle is termed a rearward angle of incline. In sum, when the force shift indicator 10 is aligned such that the top face 12 has a true horizontal orientation, the bottom central plane 24 likewise has a true horizontal orientation while the upward angles of orientation of the bottom front and rear planes 22, 26, i.e., the forward and rearward angles of incline, deviate from true horizontal. More particularly, the forward and rearward angles of incline are acute angles that are preferably substantially less than about 30° and are preferably about equal to one another.

The distance between the bottom rear plane 26 and top face 12, i.e., the thickness of the force shift indicator 10, decreases as the bottom rear plane 26 approaches the rear end of the force shift indicator 10. The rearward pivot axis 32 functions as a rearward fulcrum enabling the rear end of the force shift indicator 10 to rotate up or down about it when the force shift indicator 10 is in use. A plurality of rearward projections 34, configured and dimensioned identically to the forward projections 30, are preferably integrally formed on the bottom face 12, extending downwardly from the rearward pivot axis 32. The rearward projections 34 are arranged in an array of three longitudinally spaced apart rows in the present embodiment. One row is positioned directly on the rearward pivot axis 32 in substantially perpendicular alignment with the bottom central plane 24 and the remaining two rows are positioned immediately adjacent to the rearward pivot axis 32 on the bottom rear plane thereof. An exemplary preferred length of each projection 30, 34 is on the order of about ⅜ inch.

The first lateral face 20*a* and second lateral face 20*b* are longitudinally oriented on opposing sides of the force shift indicator 10 facing the opposite direction from one another. The lateral faces 20*a*, 20*b* are in substantially parallel vertical alignment with one another and are each preferably aligned substantially perpendicular to the front and rear faces 16, 18. The lateral faces 20*a*, 20*b* preferably maintain a constant true vertical orientation during use of the force shift indicator 10. Each lateral face 20*a*, 20*b* is a substantially continuous unitary plane. Although each lateral face 20*a*, 20*b* preferably has an identical profile, it is not a precisely rectangular profile. The height of the lateral faces 20*a*, 20*b* at each point along their length corresponds to the thickness of the force shift indicator 10 at that point. The thickness of the force shift indicator 10 differs depending on the point along the length of the lateral faces 20*a*, 20*b* where the thickness is measured.

The bottom face 14 intersects each face 16, 18, 20*a*, 20*b* and these intersections define the bottom edges of the force shift indicator 10. The bottom face 14 appears to have substantially the same rectangular profile in the plan view as the top face 12 with four straight linear edges. However, it is apparent when referencing the side elevation views of the first and second lateral faces 20*a*, 20*b* that the bottom edges of the first and second lateral faces 20*a*, 20*b*, which are correspondingly the lateral edges of the bottom face 14, are in reality each made up of three distinct non-collinear line segments that are connected end to end in sequence rather than being a single straight line.

The first lateral face 20*a* has a first bottom front line segment 36*a*, first bottom central line segment 38*a* and first bottom rear line segment 40. The second lateral face 20*b* correspondingly has a second bottom front line segment 36*b*, second bottom central line segment 38*b* and second bottom rear line segment 40*b*. The first and second bottom front line segments 36*a*, 36*b* are the intersections of the first and second lateral faces 20*a*, 20*b* and the bottom front plane 22, respectively. The first and second bottom central line segments 38*a*, 38*b* are the intersections of the first and second lateral faces 20*a*, 20*b* and the bottom central plane 24, respectively. The first and second bottom rear line segments 40*a*, 40*b* are the intersections of the first and second lateral faces 20*a* and the bottom rear plane 26, respectively. The intersections of the first and second lateral faces 20*a*, 20*b* and the bottom central plane 24, respectively, form right angles. The intersection of the first lateral face 20*a* and front face 16, of the first lateral face 20*a* and rear face 18, of the second lateral face 20*b* and front face 16 and of the second lateral face 20*b* and rear face 18, respectively, all form right angles. All of the above-recited intersections are straight lines which in total define the side edges of the force shift indicator 10.

Although the force shift indicator 10 of the present invention is not constrained to any specific dimensions, it is preferably substantially longer than it is wide, e.g., preferably on the order of about 2:1, length to width. An exemplary preferred length of the force shift indicator 10 is on the order of about 2 feet and an exemplary preferred width of the force shift indicator 10 is on the order of about 1 foot. As a general rule, the length of the bottom front plane 22, which is the distance between the forward pivot axis 28 and the front end of the force shift indicator 10, is preferably less than the length of the bottom rear plane 26, which is the distance between the rearward pivot axis 32 and the rear end of the force shift indicator 10. In addition the length of the bottom central plane 24, which is the distance between the forward and rearward pivot axes 28, 32, is preferably less than the length of either bottom front or rear plane 22, 26. An exemplary preferred length of the bottom front plane 22 is on the order of about 9 inches, an exemplary preferred length of the bottom central plane 24 is on the order of about 5 inches and an exemplary preferred length of the bottom rear plane 26 is on the order of about 11 inches.

In any case, the force shift indicator 10 is preferably sufficiently long to accommodate the width of a typical golf stance with some overage so that the outer edges of a user's feet do not extend beyond the top front and rear edges of the top face 12. The width of a golf stance is defined herein as the distance between the centerlines of the lead foot and the trail foot. The optimal golf stance width is a function of multiple variables including the individual anatomy of the golfer, the golf club selected and the desired swing length. Nevertheless, 19 inches is a representative optimal golf stance width for an average size individual taking a full swing. This stance width enables the user to position the feet on the top face 12 of the force shift indicator 10 within the top front and rear edges thereof.

The force shift indicator 10 is preferably sufficiently wide to accommodate the largest size feet of a typical golfer with some overage so that the heels and toes of a user's feet do not extend beyond the front and rear lateral edges of the force shift indicator 10. An exemplary preferred thickness of the force shift indicator 10 measured between the top face 12 and the bottom central plane 24 of the bottom face 14 is on the order of about 1 inch. An exemplary preferred thickness of the force shift indicator 10 measured at the front end of the force shift indicator 10 is on the order of about ½ inch and an exemplary preferred thickness of the force shift indicator 10 measured at the rear end of the force shift indicator 10 is on the order of about ⅜ inch.

The force shift indicator 10 is a rigid article that does not substantially flex or otherwise deform when subjected to forces applied to it by a user standing on the top face 12 and swinging a golf club. The force shift indicator 10 preferably has a unitary solid construction and is preferably fabricated from a rigid, high-strength, durable plastic. The force shift indicator 10 is preferably manufactured by molding the material of fabrication into the desired configuration. It is noted that the configuration and dimensions of the force shift indicator 10 are selected by the designer thereof and all are essentially permanently fixed upon manufacture of the force shift indicator 10.

Use of Golf Swing Force Shift Indicator

The force shift indicator 10 has utility for golf swing training when set up on a stable horizontally-oriented support surface. The support surface may be natural or artificial and preferably has a pliant tufted covering and a firm underlying base. Natural grass is a preferred natural support surface, wherein the covering is the natural grass blades and the base is the underlying soil. Preferred artificial support services include artificial turf and carpet, wherein the covering is a pile and the base is a stout sheet of backing to which the covering is attached. The pile of artificial turf is artificial grass blades and the pile of carpet is tufted yarn. Natural grass and artificial support surfaces having a long pile are characterized as relatively soft support surfaces while artificial support surfaces having a short pile are characterized as relatively hard support surfaces. FIGS. 8-11 show the different positions of the force shift indicator 10 during a preferred method of use described below. For purposes of illustration, artificial turf having a relatively short dense pile is shown as the support surface in FIGS. 8-11. However, it is understood that alternate natural or synthetic support surfaces likewise have utility in the present method in accordance with the teaching herein.

Figure 8:
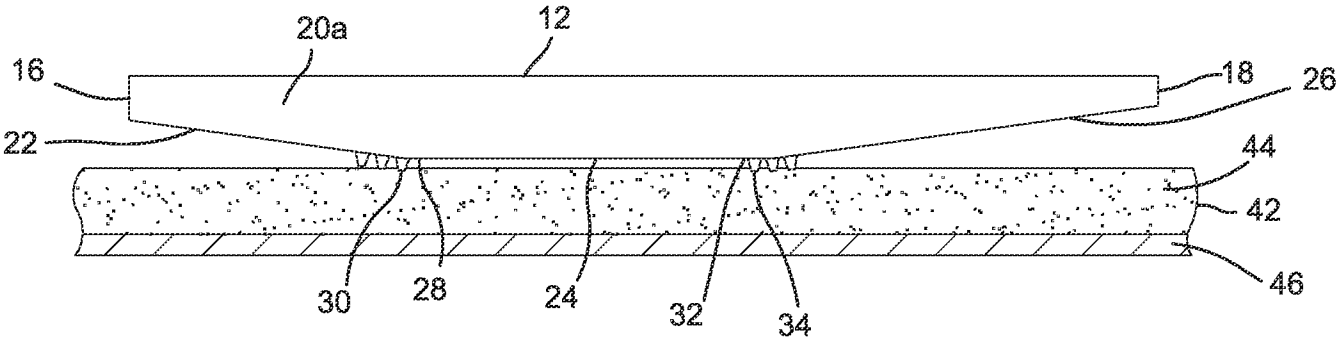
FIG. 8 shows the golf swing force shift indicator of FIG. 6 in a set-up position.

Referring initially to FIG. 8, which shows the force shift indicator 10 in the set-up position, a user sets up the force shift indicator 10 for use by placing it on a support surface 42 with the bottom face 14 facing downward against the support surface 42 while the top face 12 faces upward. The support surface 42 (shown in cross section) has a tufted covering 44 and an underlying base 46. When the force shift indicator 10 rests atop the support surface 42 without a user standing on the top face 12, the force shift indicator 10 is sufficiently balanced that the top face 12 and bottom central plane 24 maintain a true horizontal orientation that is parallel to the support surface 42. The only downward force the force shift indicator 10 applies to the support surface 42 is the deadweight of the force shift indicator 10 itself. Although the deadweight of the force shift indicator 10 is sufficient to gently press the force shift indicator 10 against the support surface 42, the deadweight is typically insufficient to cause the forward and rearward projections 30, 34 to substantially penetrate the covering 44 because the pile of the artificial turf is relatively dense and resistant to penetration. As a result, the bottom face 14 does not engage the support surface 42; only the forward and rearward projections 30, 34 engage the support surface 42 and support the force shift indicator 10 atop the support surface 42. Thus, it is apparent that the bottom front and rear planes 22, 26 do not substantially impinge on the support surface 42 when the force shift indicator 10 is in the set-up position.

Figure 2:
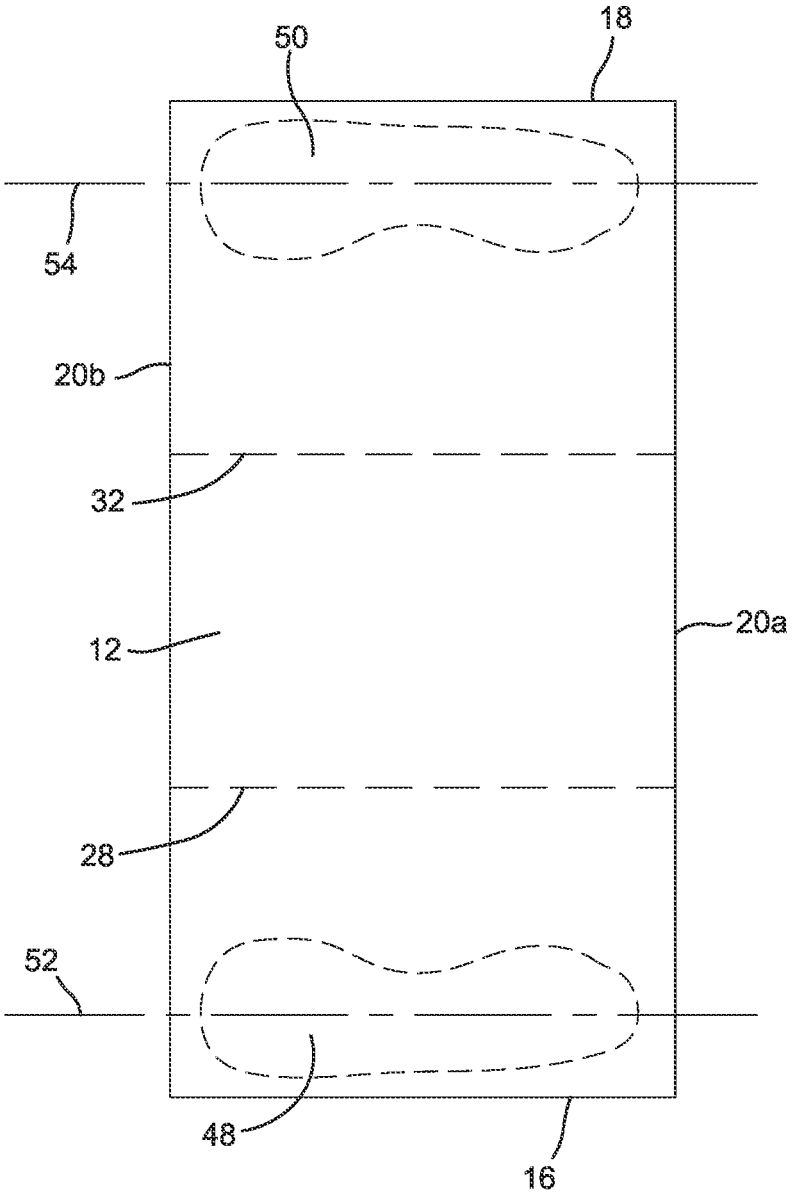
FIG. 2 is a top plan view of the golf swing force shift indicator shown in FIG. 1.
Figure 3:
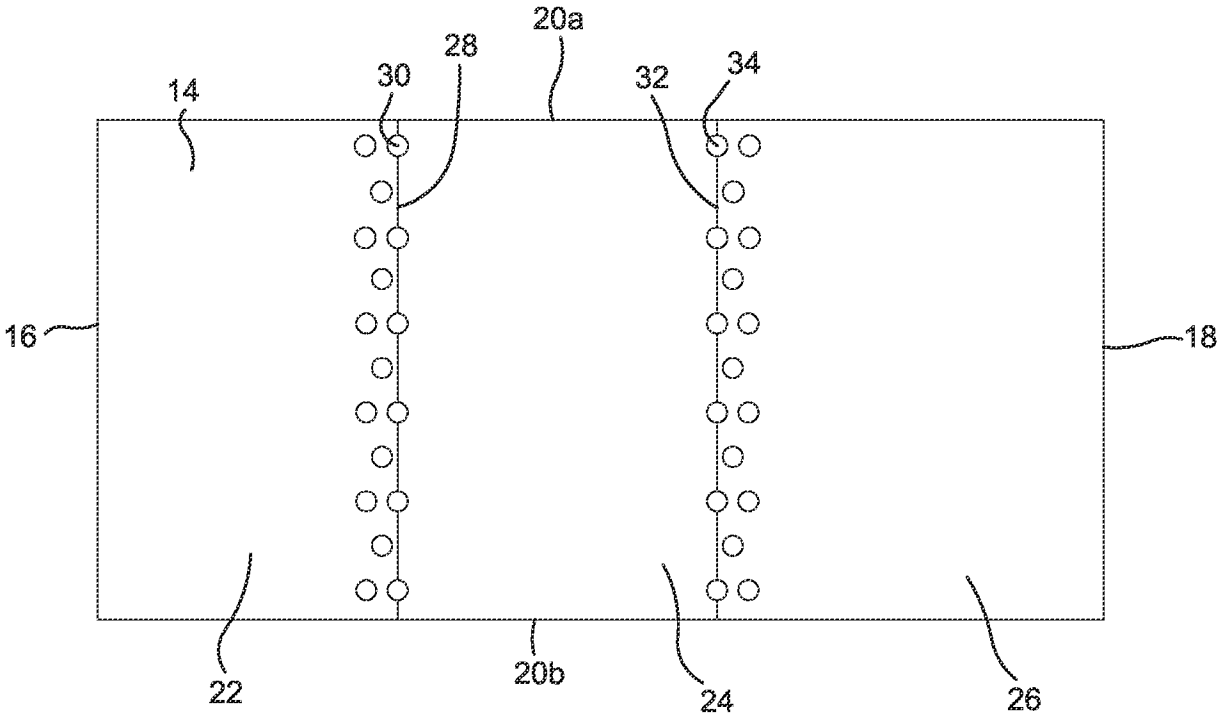
FIG. 3 is a bottom plan view of the golf swing force shift indicator shown in FIG. 1.
Figure 4:
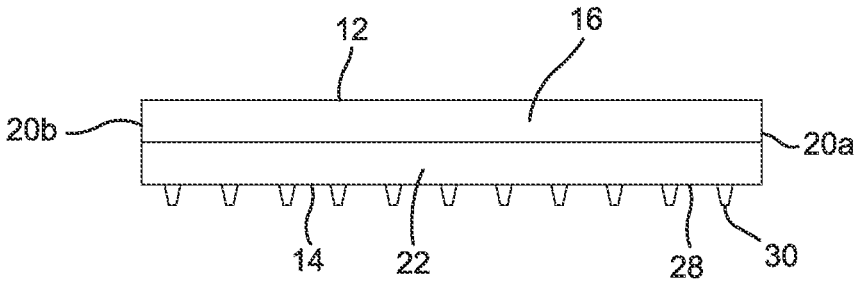
FIG. 4 is a front elevation view of the golf swing force shift indicator shown in FIG. 1.
Figure 5:
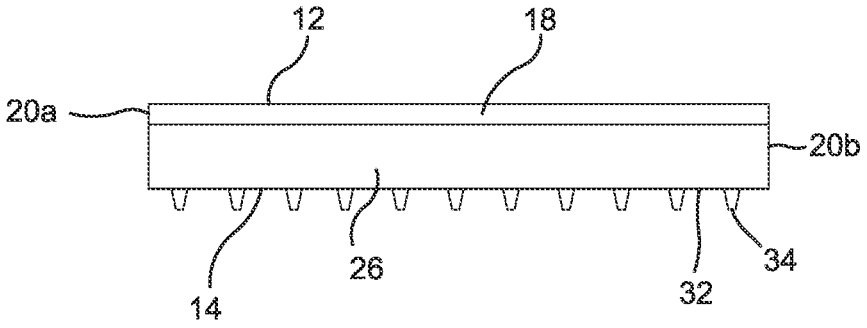
FIG. 5 is a rear elevation view of the golf swing force shift indicator shown in FIG. 1.
Figure 6:
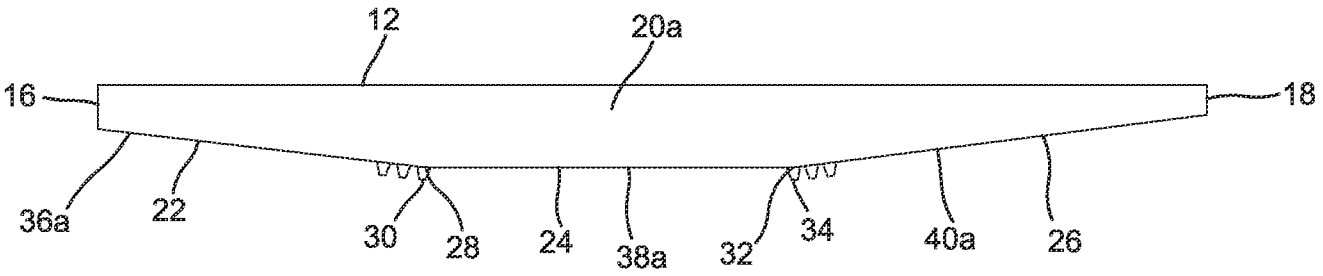
FIG. 6 is a first side elevation view of the golf swing force shift indicator shown in FIG. 1.
Figure 7:
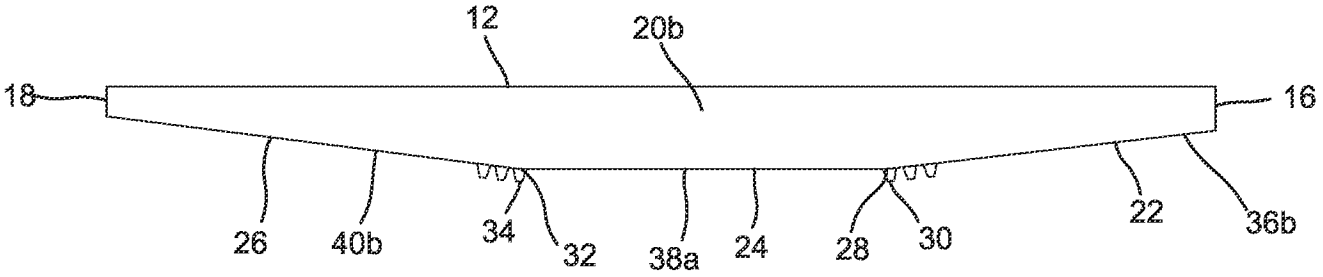
FIG. 7 is a second side elevation view of the golf swing force shift indicator shown in FIG. 1.

To initiate use of the force shift indicator 10 after set-up, the user selects a desired golf club and holds the club handle using a normal golf grip. With the golf club in hand, the user (not shown) steps onto the top face 12 of the force shift indicator 10 and assumes a normal good golf stance and posture. In particular, the user firmly plants the lead foot on a predetermined lead foot placement site on the top face 12 immediately adjacent to the front end of the force shift indicator 10. The user similarly firmly plants the trail foot on a predetermined trail foot placement site on the top face 12 immediately adjacent to the rear end of the force shift indicator 10. Representations of the lead and trail foot placement sites 48, 50, respectively, are shown in FIGS. 1 and 2. Representations of their longitudinal centerlines 52, 54, respectively, are shown in FIG. 2. The longitudinal centerlines 52, 54 are aligned substantially perpendicular to the longitudinal axis of the top face 12, substantially parallel to one another and substantially parallel to the forward and rearward pivot axes 28, 32. Although the pivot axes 28, 32 and foot placement sites 48, 50 reside on opposite faces of the force shift indicator 10, the relative longitudinal positions of the pivot axes 28, 32 are between the longitudinal centerlines 52, 54 of the foot placement sites 48, 50. The forward pivot axis 28 is more proximal to the lead foot placement site 48 than it is to the trail foot placement site 50 while the rearward pivot axis 32 is more proximal to the trail foot placement site 50 than it is to the lead foot placement site 48.

For a right-handed user the left foot is the lead foot and the right foot is the trail foot. For a left-handed user the positions of the feet are reversed; the right foot is the lead foot and the left foot is the trail foot. The method of use is described hereafter with reference to a right-handed user. However, it is apparent to the ordinary artisan that the same method can be readily adapted to a left-handed user. It is additionally noted that when the term foot (or feet) is used herein it generally refers to a foot (or feet) with a shoe worn on it since the user of the force shift indicator 10 is preferably wearing shoes.

The present method of use requires the user to perform an actual or simulated golf swing while standing on the force shift indicator 10. A golf swing, whether actual or simulated, is generally performed in multiple stages, namely, an address, backswing, downswing, impact and follow-through stage. The only difference between an actual and simulated golf swing is the impact stage; all of the other stages are the same for the actual and simulated golf swing. In an actual golf swing the user strikes a real golf ball during the impact stage, but in a simulated golf swing the golf ball is imaginary so the user merely mimics the movements of striking a real golf ball during the impact stage.

Figure 9:
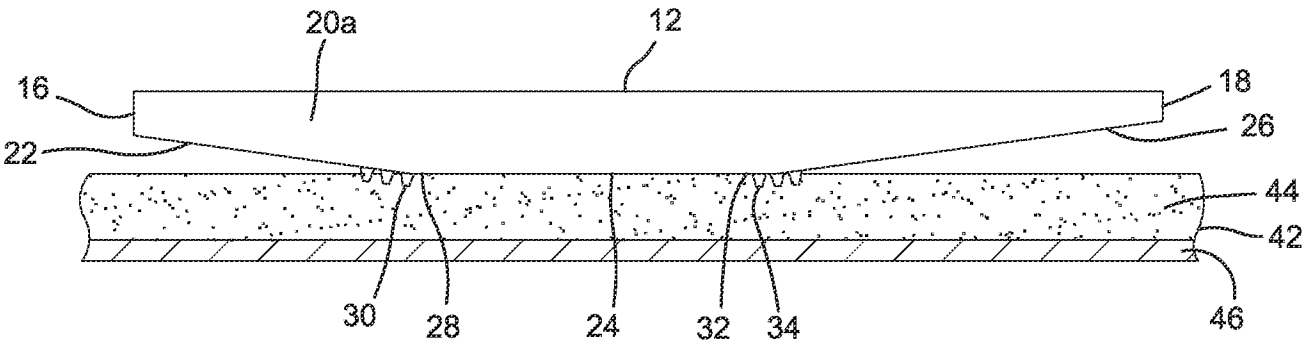
FIG. 9 shows the golf swing force shift indicator of FIG. 6 in a balanced position.

Once the user assumes a normal golf stance on the top face 12 with the golf club in hand, the user performs the address stage by distributing the user's downward force essentially evenly, i.e., fifty-fifty, between both feet, positioning the club head immediately behind a real or phantom golf ball and positioning the hands and club handle in a direct line between the ball and user's head with both arms straightened and extending downwardly. Referring to FIG. 9, which shows the force shift indicator 10 in the balanced position, the force shift indicator 10 presses more forcefully against the support surface 42 than in the set-up position due to the added body weight of the user standing on the top face 12. The added body weight of the user causes all of the forward and rearward projections 30, 34 to engage the covering 44 and enables them to overcome the resistance of the pile and penetrate the covering 44. Consequently, the bottom central plane 24 also engages the covering 44 and impinges on the support surface 42. Regardless, when the force shift indicator 10 is in the balanced position, the bottom central plane 24 and top face 12 always maintain a parallel orientation relative to the underlying base 46 of the support surface 42 and the bottom front and rear planes 22, 26 do not substantially impinge on the support surface 42.

The user sequentially performs the backswing stage following the address stage. At the outset of the backswing stage, the user's downward force begins to shift rearwardly from the balanced downward force distribution of the balanced position to a rearward-dominant body force distribution favoring the trail foot, i.e., the trail foot applies a greater degree of downward force toward the ground than does the user's lead foot. During progression of the backswing stage the user achieves an optimal rearward-dominant downward force distribution which the force shift indicator 10 advantageously automatically indicates to the user by simple tactile means. In a preferred case, the optimal rearward-dominant downward force distribution is achieved when at least 60% of the user's total downward force is applied with the trail foot and only 40% or less is applied with the lead foot.

This feature of the force shift indicator 10 is enabled by precisely selecting the longitudinal distance between the rearward pivot axis 32 and the longitudinal centerline 54 of the trail foot placement site 50, termed the rearward leverage distance, so that the bottom rear plane 26 instantaneously rotates downwardly about the rearward pivot axis 32 to engage the support surface 42 at the precise moment when the downward force applied to the top plate 12 by the trail foot reaches an optimal fraction of the user's total downward force applied toward the ground, which in a preferred case is 60% or more. This downward rotation of the bottom rear plane 26 into engagement with the support surface 42 is characterized as abrupt rather than gradual, which provides the user with a definitive indicator when the optimal rearward-dominant downward force distribution is achieved.

Figure 10:
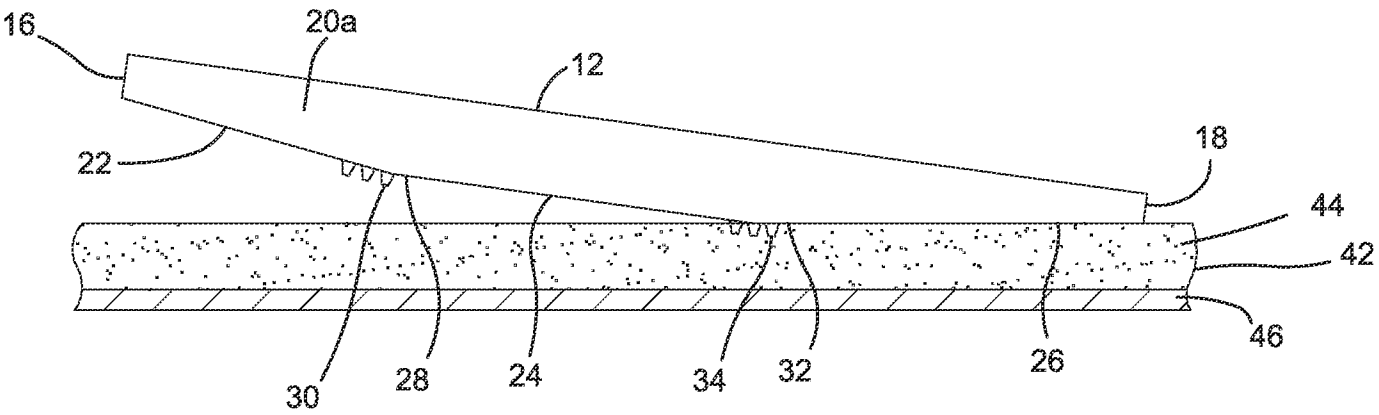
FIG. 10 shows the golf swing force shift indicator of FIG. 6 in an unbalanced rearward-dominant position.

The enhanced force of the trail foot on the top plate 12 causes the bottom rear plane 26 to forcefully press against and impinge on the support surface 42. Simultaneous with downward rotation of the bottom rear plane 26, the bottom front and central planes 22, 24 rotate upwardly about the rearward pivot axis 32 in response to the downward force shift. Consequently, the bottom central plane 24 is disengaged from the support surface 42 and the bottom front and central planes 22, 24 do not substantially impinge on the support surface 42. It is further noted that the rearward projections 34 beneficially prevent undesirable rotation of the force shift indicator 10 within a plane of rotation parallel to the support surface 42 as the force shift indicator 10 rotates about the rearward pivot axis 32 within the desired plane of rotation that is perpendicular to the support surface 42. The above-described position of the force shift indicator 10 is shown in FIG. 10 and is termed an unbalanced rearward-dominant position. The force shift indicator 10 stays in the unbalanced rearward-dominant position as long as the trail foot continues to apply the optimal fraction of the user's total downward force toward the ground.

Immediately prior to reaching the top of the backswing stage the user's downward force begins to shift from the trail foot to the lead foot and continues to shift to the lead foot as the user transitions from the backswing stage to the downswing stage. As the downswing stage progresses a greater fraction of the user's total downward force shifts to the lead foot until reaching a mid-point of the downswing stage where the user achieves an optimal forward-dominant downward force distribution that the force shift indicator 10 advantageously automatically indicates to the user by simple tactile means. In a preferred case, the optimal forward-dominant downward force distribution is achieved when at least 70% of the user's total downward force is applied with the lead foot and only 30% or less is applied with the trail foot.

This feature of the force shift indicator 10 is enabled by precisely selecting the longitudinal distance between the forward pivot axis 28 and the longitudinal centerline 52 of the lead foot placement site 48, termed the forward leverage distance, so that the bottom front plane 22 instantaneously rotates downwardly about the forward pivot axis 28 to engage the support surface 42 at the precise moment when the downward force applied to the top plate 12 by the lead foot reaches an optimal fraction of the user's total downward force, which in a preferred case is 70% or more. This downward rotation of the bottom front plane 22 into engagement with the support surface 42 is characterized as abrupt rather than gradual, which provides the user with a definitive indicator when the optimal unbalanced forward-dominant downward force distribution is achieved.

Figure 11:
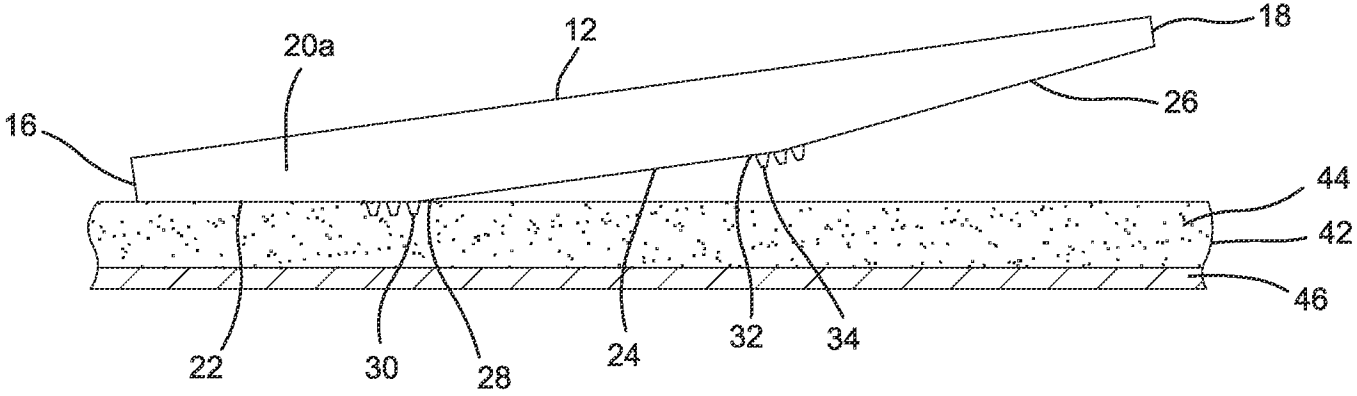
FIG. 11 shows the golf swing force shift indicator of FIG. 6 in an unbalanced forward-dominant position.

The enhanced force of the lead foot on the top plate 12 causes the bottom front plane 22 to press firmly against and impinge on the support surface. Simultaneous with downward rotation of the bottom front plane 22, the bottom central and rear planes 24, 26 rotate upwardly about the forward pivot axis 28 in response to the downward force shift. Consequently, the bottom rear plane 26 and the bottom central and rear planes 24, 26 do not substantially impinge on the support surface 42. It is further noted that the forward projections 30 beneficially prevent undesirable rotation of the force shift indicator 10 within a plane of rotation parallel to the support surface 42 as the force shift indicator 10 rotates about the forward pivot axis 28 within the desired plane of rotation that is perpendicular to the support surface 42. The above-described position of the force shift indicator 10 is shown in FIG. 11 and is termed an unbalanced forward-dominant position. The force shift indicator 10 stays in the unbalanced forward-dominant position as long as the lead foot continues to apply the optimal fraction of the user's total downward force toward the ground. This desirably occurs throughout the remainder of the golf swing, i.e., throughout the impact and follow-through stages.

The mechanics of the backswing and downswing stages of a golf swing are disclosed in greater detail in co-pending U.S. patent application Ser. No. 16/738,372 having the same inventors filed on Jan. 9, 2020 and published on Jul. 16, 2020 as U.S. Patent Application Publication No. 2020/00222779 A1 which is incorporated herein by reference. It is noteworthy that although the golfer's downward force distribution preferably shifts as described above in the backswing and downswing stages of a long game golf swing, the golfer's weight typically remains generally centered, i.e., the golfer's weight distribution remains generally balanced, throughout a long game golf swing.

It is apparent from the above description that the force shift indicator 10 is essentially two simple mechanical advantage devices incorporated into a single integrated structure. Each mechanical advantage device is a class one lever that operates on the same principle as a seesaw. As such, each lever has a beam and a fulcrum positioned under the beam between the two ends of the beam. The load is applied to one end of the beam and the effort is applied to the other end of the beam. With reference to the force shift indicator 10, the first device, termed a forward lever, has a beam which is the portion of the top face 12 extending between the lead foot placement site 48 and the trail foot placement site 50. The fulcrum of the forward lever is the forward pivot axis 28 on the bottom face 14 of the force shift indicator 10. The second device, termed a rearward lever, has the same beam as the forward lever, but the fulcrum of the rearward lever is the rearward pivot axis 32.

A practitioner of the instant invention precisely selects the design dimensions of the force shift indicator 10, and specifically the rearward leverage distance and forward leverage distance, to achieve optimal transition of the force shift indicator 10 from the balanced position to the unbalanced rearward-dominant position and optimal transition of the force shift indicator 10 from the unbalanced rearward-dominant position back through the balanced position to the unbalanced forward-dominant position. It is known that the force required to pivot one end of the beam of a lever downwardly about the fulcrum is inversely related to the distance between that end of the beam and the fulcrum. It is further known that the preferred optimal fraction of the user's total downward force applied by the trail foot during the backswing stage of the golf swing is less than the preferred optimal fraction of the user's total downward force applied by the lead foot during the downswing stage of the golf swing. Therefore, it is apparent that a lesser force is required to rotate the force shift indicator 10 to the unbalanced rearward-dominant position than to the unbalanced forward-dominant position. As a result, the rearward leverage distance must be greater than forward leverage distance on the force shift indicator 10.

A preferred rearward leverage distance and forward leverage distance may be more precisely specified by first specifying a representative optimal swing stance width and also precisely specifying the optimal fraction of the user's total downward force to be applied by the trail foot during the backswing stage and the optimal fraction of the user's total downward force to be applied by the lead foot during the downswing stage. Thus, for example, one may select 19 inches as the optimal swing stance width. One may also select 60% as the optimal fraction of the user's total downward force to be applied by the trail foot during the backswing stage and 70% as the optimal fraction of the user's total downward force to be applied by the lead foot during the downswing stage. Given these fixed variables, the preferred rearward leverage distance is calculated using the following equation:

swing stance width×(1−total downward force fraction applied by trail foot)=rearward leverage distance 19 inches×(1−0.6)=7.6 inches Thus, the preferred rearward leverage distance in the present example is 7.6 inches.

The preferred forward leverage distance is similarly calculated using the following equation:

swing stance width×(1−total downward force fraction applied by lead foot)=forward leverage distance 19 inches×(1−0.7)=5.7 inches Thus, the preferred forward leverage distance in the present example is 5.7 inches.

It is within the scope of the present invention to incorporate additional optional design elements into the force shift indicator 10 which are not shown in the drawings, but are described below. These additional optional design elements facilitate use of the force shift indicator 10 without departing from the above teaching regarding use. For example, it may be desirable to round or bevel some or all of the sharp edges or corners of the force shift indicator 10 to blunt them, thereby preventing them from injuring skin or damaging objects that come into contact with them. When such edges or corners are beveled or rounded, it is understood that the intersecting faces at the beveled or rounded edges or corners still fall within the present characterization of being perpendicular or at right angles to one another.

It may also be desirable to form a tread on the top face 12 of the force shift indicator 10 integral therewith to secure the grip of the user's feet on the top face 12. An exemplary tread is a plurality of low-profile ridges raised about ⅛ inch from the underlying plane and arranged in a crisscross pattern across the entirety of the top face 12. The tread may also include a single low-profile ridge extending around the perimeter of the top face 12. Directional markings may also be provided on the top face 12 to identify the front of the force shift indicator 10 and/or the rear of the force shift indicator 10.

It may also be desirable to form a pair of handhold holes in the force shift indicator 10 that extend through the entire thickness thereof, passing from the top face 12 to the bottom face 14. One handhold hole may be situated near the front end of the force shift indicator 10 and the second may be situated opposite the first handhold hole near the rear end of the force shift indicator 10. Such handhold holes are preferably configured and dimensioned only large enough to receive a user's hand therein and are positioned sufficiently near a respective end of the force shift indicator 10 to enable the user to securely grasp and lift the force shift indicator 10 by inserting all four fingers of the hand into the handhold hole and closing the fingers into a first enclosing the narrow strip of the force shift indicator 10 that extends between the outer edge of the handhold hole and the nearest end of the force shift indicator 10. As such, the handhold holes facilitate manual transport of the force shift indicator 10 and also facilitate positioning the force shift indicator 10 during setup. It is understood that characterization of the top face 12 herein as a single continuous unitary plane encompasses the inclusion of a tread on the top face 12 and handhold holes extending through the top face 12.

It may be further desirable to integrate a plurality of cutouts bounded by a plurality of ribs into the bottom face 14 of the force shift indicator 10 during manufacturing so that the bottom face 14 has a ribbed construction. It is well known that using a ribbed construction to fabricate solid objects beneficially reduces the weight of the object, the amount of material required to manufacture it and correspondingly the cost of manufacture without sacrificing the structural integrity or utility of the object. In the present case, the cutouts of the ribbed construction preferably only extend from the bottom face 14 partially through the overall thickness of the force shift indicator 10 and do not extend through the top face 12. When the force shift indicator 10 has a ribbed construction, an exemplary distance between the top face 12 and the uppermost part of a cutout approaching the top face 12 is on the order of about ¼ inch. Notwithstanding the above, it is understood that characterization of the bottom planes 22, 24, 26 as continuous unitary planes encompasses the present ribbed construction. When a ribbed construction is used, the overall thickness of the force shift indicator 10 is measured from the bottom edge of the ribs to the top face 12 and the angles of incline are determined with reference to the bottom edge of the ribs.

It is additional noted that U.S. patent application Ser. No. 17/978,108, entitled "Golf Shot Weight Distribution Indicator", having the same inventors and filing date as the instant application, is incorporated herein by reference.

While the forgoing preferred embodiments of the invention have been described and shown herein, it is understood that alternatives and modifications, such as those suggested and others, may be made thereto and fall within the scope of the invention. For example, although preferred design dimensions of the force shift indicator have been disclosed above, it is readily apparent to one of ordinary skill in the art applying the teaching herein that it is alternatively within the scope of the present invention to further vary the design dimensions of the force shift indicator to accommodate different users' needs. As another example, the method of use disclosed herein applies to the case where the user is taking a full swing. It is further within the purview of the ordinary artisan to adapt this method of use for application to cases where the user is taking a shortened swing.

We claim:

1. A golf swing force shift indicator comprising:

a top face, a bottom face, a front face positioned at a front end of said force shift indicator and a rear face positioned at a rear end of said force shift indicator, wherein said bottom face extends from said front end to said rear end of said force shift indicator;

a continuous unitary plane forming said top face and extending from said front end to said rear end of said force shift indicator, wherein said top face has a lead foot placement site with a longitudinal centerline positioned more proximal to said front end than to said rear end and a trail foot placement site with a longitudinal centerline positioned more proximal to said rear end than to said front end; and a bottom front plane, a bottom central plane and a bottom rear plane forming said bottom face, wherein said bottom front, central and rear planes are sequentially positioned relative to one another in a series along the length of said bottom face, said bottom front plane has a different angular orientation relative to said bottom central plane, said bottom rear plane has a different angular orientation relative to said bottom central plane, said bottom central plane intersects said bottom front plane along a forward pivot axis and said bottom central plane intersects said bottom rear plane along a rearward pivot axis.

2. The golf swing force shift indicator of claim 1, wherein said bottom central plane is parallel to said top face.

3. The golf swing force shift indicator of claim 2, wherein said angular orientation of said bottom front plane defines a forward angle of incline that is upward relative to said bottom central plane.

4. The golf swing force shift indicator of claim 3, wherein said forward angle of incline is less than 30°.

5. The golf swing force shift indicator of claim 2, wherein said angular orientation of said bottom rear plane defines a rearward angle of incline that is upward relative to said bottom central plane.

6. The golf swing force shift indicator of claim 5, wherein said rearward angle of incline is less than 30°.

7. The golf swing force shift indicator of claim 1, wherein a longitudinal distance between said forward pivot axis and said longitudinal centerline of said lead foot placement site defines a forward leverage distance, a longitudinal distance between said rearward pivot axis and said longitudinal centerline of said trail foot placement site defines a rearward leverage distance and said rearward leverage distance is greater than said forward leverage distance.

8. The golf swing force shift indicator of claim 1 further comprising two or more forward projections extending downwardly from said forward pivot axis.

9. The golf swing force shift indicator of claim 1 further comprising two or more rearward projections extending downwardly from said rearward pivot axis.

10. A golf swing force shift indicator comprising:

a top face, a bottom face, a front face positioned at a front end of said force shift indicator and a rear face positioned at a rear end of said force shift indicator, wherein said bottom face extends from said front end to said rear end of said force shift indicator;

a continuous unitary plane forming said top face and extending from said front end to said rear end of said force shift indicator, wherein said top face has a lead foot placement site with a longitudinal centerline positioned more proximal to said front end than to said rear end and a trail foot placement site with a longitudinal centerline positioned more proximal to said rear end than to said front end; and a bottom front plane, a bottom central plane and a bottom rear plane forming said bottom face, wherein said bottom front, central and rear planes are sequentially positioned relative to one another in a series along the length of said bottom face, said bottom front plane has an upward angular orientation relative to said bottom central plane defining a forward angle of incline, said bottom rear plane has an upward angular orientation relative to said bottom central plane defining a rearward angle of incline, said bottom central plane intersects said bottom front plane along a forward pivot axis and said bottom central plane intersects said bottom rear plane along a rearward pivot axis.

11. The golf swing force shift indicator of claim 10, wherein a longitudinal distance between said forward pivot axis and said longitudinal centerline of said lead foot placement site defines a forward leverage distance, a longitudinal distance between said rearward pivot axis and said longitudinal centerline of said trail foot placement site defines a rearward leverage distance and said rearward leverage distance is greater than said forward leverage distance.

12. The golf swing force shift indicator of claim 10, wherein said bottom central plane is parallel to said top face.

13. The golf swing force shift indicator of claim 10, wherein said forward angle of incline is less than 30°.

14. The golf swing force shift indicator of claim 10, wherein said forward angle of incline is less than 30°.

15. The golf swing force shift indicator of claim 10 further comprising two or more forward projections extending downwardly from said forward pivot axis.

16. The golf swing force shift indicator of claim 10 further comprising two or more rearward projections extending downwardly from said rearward pivot axis.

17. A golf swing force shift indicator comprising:

a top face, a bottom face, a front face positioned at a front end of said force shift indicator and a rear face positioned at a rear end of said force shift indicator, wherein said bottom face extends from said front end to said rear end of said force shift indicator;

a continuous unitary plane forming said top face and extending from said front end to said rear end of said force shift indicator, wherein said top face has a lead foot placement site with a longitudinal centerline positioned more proximal to said front end than to said rear end, a trail foot placement site with a longitudinal centerline positioned more proximal to said rear end than to said front end; and a bottom front plane, a bottom central plane and a bottom rear plane forming said bottom face, wherein said bottom front, central and rear planes are sequentially positioned relative to one another in a series along the length of said bottom face, said bottom front plane has an upward angular orientation relative to said bottom central plane defining a forward angle of incline, said bottom rear plane has an upward angular orientation relative to said bottom central plane defining a rearward angle of incline, said bottom central plane intersects said bottom front plane along a forward pivot axis and said bottom central plane intersects said bottom rear plane along a rearward pivot axis, a longitudinal distance between said forward pivot axis and said longitudinal centerline of said lead foot placement site defines a forward leverage distance, a longitudinal distance between said rearward pivot axis and said longitudinal centerline of said trail foot placement site defines a rearward leverage distance and said rearward leverage distance is greater than said forward leverage distance.

18. The golf swing force shift indicator of claim 17, wherein said bottom central plane is parallel to said top face.

* * * * *